US011300143B2

(12) United States Patent
Ito et al.

(10) Patent No.: US 11,300,143 B2
(45) Date of Patent: Apr. 12, 2022

(54) DRIVE METHOD AND DRIVE DEVICE FOR FLUID PRESSURE CYLINDER

(71) Applicant: SMC CORPORATION, Chiyoda-ku (JP)

(72) Inventors: Satoru Ito, Tsuchiura (JP); Gen Tsuchiya, Tsukubamirai (JP); Masayuki Ishikawa, Toride (JP); Hisashi Yajima, Tsukuba (JP); Takehiko Kanazawa, Kashiwa (JP)

(73) Assignee: SMC CORPORATION, Chiyoda-ku (JP)

( * ) Notice: Subject to any disclaimer, the term of this patent is extended or adjusted under 35 U.S.C. 154(b) by 0 days.

(21) Appl. No.: 17/056,646

(22) PCT Filed: Jul. 25, 2018

(86) PCT No.: PCT/JP2018/027817
§ 371 (c)(1),
(2) Date: Nov. 18, 2020

(87) PCT Pub. No.: WO2019/225022
PCT Pub. Date: Nov. 28, 2019

(65) Prior Publication Data

US 2021/0199140 A1 Jul. 1, 2021

(30) Foreign Application Priority Data

May 21, 2018 (JP) ..... JP2018-096738

(51) Int. Cl.
*F15B 11/02* (2006.01)
*F15B 11/024* (2006.01)
*F15B 11/064* (2006.01)

(52) U.S. Cl.
CPC ..... *F15B 11/024* (2013.01); *F15B 11/064* (2013.01)

(58) Field of Classification Search
CPC ..... F15B 2011/0243; F15B 11/024; F15B 2011/0246; F15B 11/064; E02F 9/2217
See application file for complete search history.

(56) References Cited

U.S. PATENT DOCUMENTS

2007/0227136 A1* 10/2007 Pfaff ..... F15B 21/085 60/422
2010/0089045 A1 4/2010 Shimada et al.
(Continued)

FOREIGN PATENT DOCUMENTS

CN 101245794 A 8/2008
CN 104295545 A 1/2015
(Continued)

OTHER PUBLICATIONS

International Search Report dated Oct. 30, 2018 in PCT/JP2018/027817 filed on Jul. 25, 2018, 1 page.
(Continued)

*Primary Examiner* — Abiy Teka
(74) *Attorney, Agent, or Firm* — Oblon, McClelland, Maier & Neustadt, L.L.P.

(57) ABSTRACT

A drive device for driving a fluid pressure cylinder has an air supply source which supplies air, a switching valve which switches between the supply and discharge of the air to and from the fluid pressure cylinder, bypass piping which connects the head-side cylinder chamber and rod-side cylinder chamber of the fluid pressure cylinder, and a bypass switching valve which switches between the states of flow of air through the bypass piping. Air in the head-side cylinder chamber is supplied to the rod-side cylinder chamber through the bypass piping by setting the bypass switching valve to an open state in a return stroke of the fluid pressure cylinder.

11 Claims, 12 Drawing Sheets

(56) References Cited

U.S. PATENT DOCUMENTS

| | | | | |
|---|---|---|---|---|
| 2013/0167522 | A1* | 7/2013 | Oguma | F15B 11/044 60/462 |
| 2018/0017087 | A1 | 1/2018 | Nakajima et al. | |
| 2019/0027731 | A1 | 9/2019 | Takakuwa et al. | |

FOREIGN PATENT DOCUMENTS

| | | | |
|---|---|---|---|
| CN | 206770305 | U | 12/2017 |
| EP | 2 128 453 | A1 | 12/2009 |
| JP | 8-193601 | A | 7/1996 |
| JP | 2016-145592 | A | 8/2016 |
| JP | 2018-54117 | A | 4/2018 |
| WO | WO 2008/108013 | A1 | 9/2008 |

OTHER PUBLICATIONS

Written Opinion dated Sep. 26, 2019 in PCT/JP2018/027817 filed on Jul. 25, 2018, 7 pages.
Supplementary European Search Report dated Feb. 24, 2020 in European Application No. 18867312.3, 4 pages.
European Office Action dated Mar. 12, 2020 in European Application No. 18867312.3, 7 pages.
Combined Chinese Search Report and Office Action (with unedited computer-generated English translation) dated May 8, 2020 in Chinese Application No. 201880004154.4, 17 pages.

* cited by examiner

DRIVE METHOD AND DRIVE DEVICE FOR FLUID PRESSURE CYLINDER

TECHNICAL FIELD

The present invention relates to a driving method and a driving apparatus (device) for driving a fluid pressure cylinder under operation of supplying fluid.

BACKGROUND ART

In Japanese Laid-Open Patent Publication No. 2018-054117, the applicant of the present application proposes a driving apparatus for driving a fluid pressure cylinder under operation of supplying fluid. In a driving step of driving the piston to move in one direction, the fluid pressure cylinder is operated with a large output, and in a returning step of driving the piston to move in a direction opposite to the direction in the driving step, the output is suppressed to operate the fluid pressure cylinder rapidly.

This driving apparatus is applicable to the fluid pressure cylinder. The driving apparatus includes a switching valve which can switch between a plurality of fluid channels, and an air supply source for supplying a high pressure air. Under switching operation of the switching valve, the high pressure air is supplied from the air supply source to a head-side cylinder chamber of the fluid pressure cylinder, and concurrently, air in the rod-side cylinder chamber is discharged from an exhaust port through a throttle valve.

Further, a check valve is provided between a fifth port in the switching valve and the head-side cylinder chamber for allowing air to flow from the head-side cylinder chamber to the switching valve. Further, in the returning step of the fluid pressure cylinder, when air is discharged from the head-side cylinder chamber, part of the air is supplied from the head-side cylinder chamber to the rod-side cylinder chamber through the switching valve.

SUMMARY OF INVENTION

A general object of the present invention is to reduce consumption of fluid and shorten the time required for a returning step, by utilizing discharged fluid to drive the fluid pressure cylinder.

According to an aspect of the present invention, a driving method of driving a fluid pressure cylinder under operation of supplying fluid is provided. The method includes a driving step of moving a piston in one direction, and a returning step of moving the piston in the other direction, wherein in the driving step, the fluid is supplied from a supply source to one of cylinder chambers in the fluid pressure cylinder while the fluid is discharged from the other of the cylinder chambers to the outside, and the returning step includes the steps of: supplying part of the fluid accumulated in the one cylinder chamber to the other cylinder chamber, to thereby move the piston in the other direction by a predetermined distance; and supplying fluid from the supply source to the other cylinder chamber to thereby further move the piston in the other direction and discharging the fluid from the one cylinder chamber to the outside.

In the present invention, in the driving step of driving the fluid pressure cylinder, the fluid is supplied from the supply source to one of the cylinder chambers in the fluid pressure cylinder, and the fluid is discharged from the other of the cylinder chambers to the outside. Further, in the returning step of the fluid pressure cylinder, part of the fluid accumulated in the one cylinder chamber is supplied to the other cylinder chamber, to thereby move the piston in the other direction by a predetermined distance. Thereafter, the fluid is supplied from the supply source to the other cylinder camber to thereby further move the piston in the other direction.

Therefore, in the returning step of the fluid pressure cylinder, the fluid discharged from the one cylinder chamber is utilized to move the piston, so that it is possible to reduce the fluid consumption in comparison with the case where the returning operation is performed by utilizing only the fluid from the supply source. Further, in the returning step, the piston starts to move, and at the same time, it is possible to supply the fluid from the one cylinder chamber to the other cylinder chamber to thereby increase the pressure in the other cylinder chamber while decrease the pressure in the one cylinder chamber. Therefore, it is possible to perform the retuning operation of the piston rapidly.

As a result, by driving the piston utilizing the fluid discharged in the returning step of the fluid pressure cylinder, it is possible to reduce the fluid consumption and further shorten the time required for the returning step.

DESCRIPTION OF EMBODIMENTS

Figure 1:
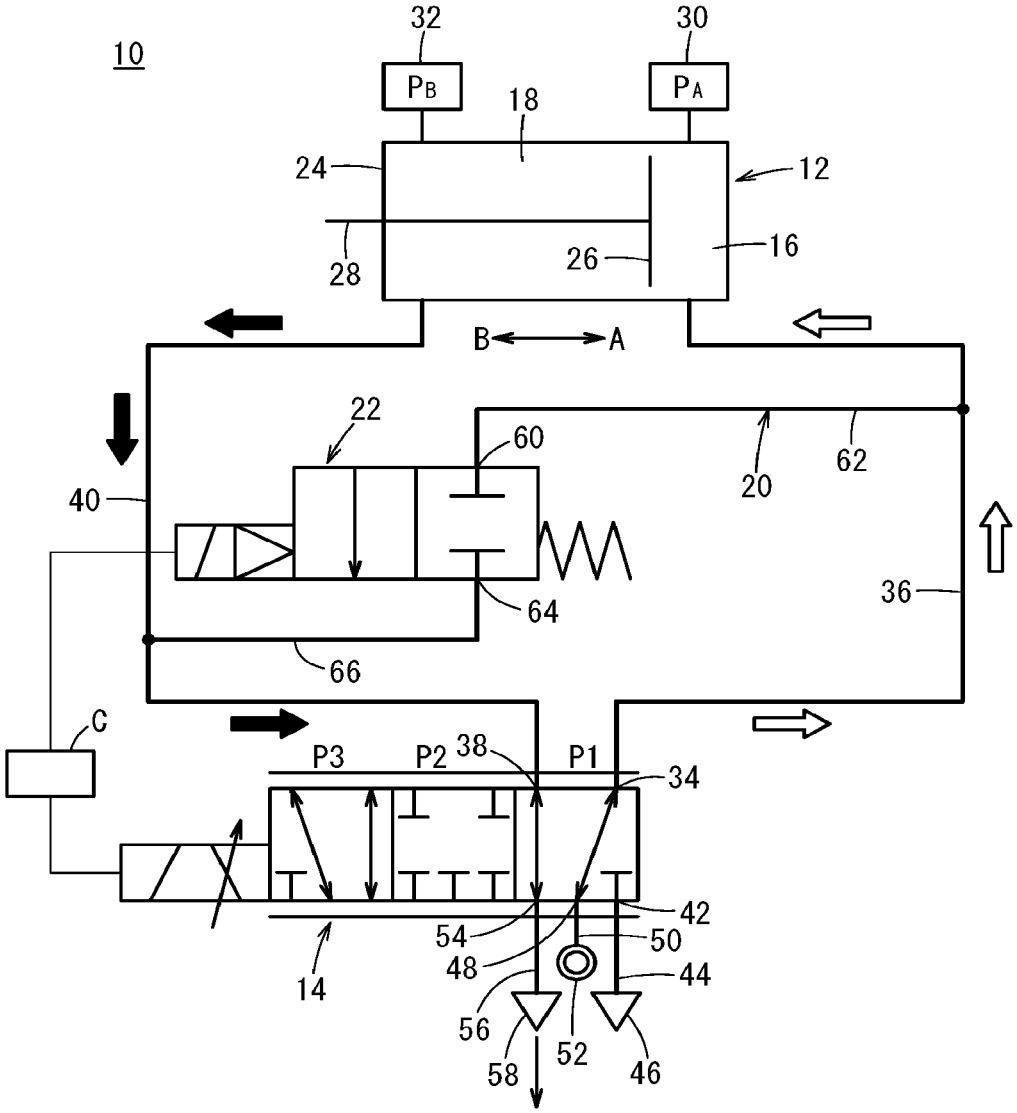
FIG. 1 is a circuit diagram showing an apparatus for driving a fluid pressure cylinder according to an embodiment of the present invention.

As shown in FIGS. 1 to 4, a driving apparatus 10 for a fluid pressure cylinder is applied to a double acting fluid pressure cylinder 12. The driving apparatus 10 includes a switching valve (first switching valve) 14 for switching between a supply state of supplying an air (fluid) to the fluid pressure cylinder 12 and a discharge state of discharging an air (fluid) from the fluid pressure cylinder 12, a bypass pipe (connection channel) 20 for connecting a head-side cylinder chamber 16 and a rod-side cylinder chamber 18 in the fluid pressure cylinder 12, and a bypass switching valve (second switching valve) 22 for switching a communication state of the bypass pipe 20.

The fluid pressure cylinder 12 includes a hollow cylinder body 24, a piston 26 capable of moving back and forth inside the cylinder body 24, and a piston rod 28 coupled to the piston 26. The other end of the piston rod 28 protrudes outward from the cylinder body 24, and is exposed to the outside.

The cylinder body 24 is partitioned into two chambers by the piston 26 provided inside the cylinder body 24. The cylinder body 24 includes the head-side cylinder chamber 16 positioned between one end of the cylinder body 24 (in the direction indicated by the arrow A) and the piston 26, and the rod-side cylinder chamber 18 containing the piston rod 28, formed between the other end of the cylinder body 24 (in the direction indicated by the arrow B) and the piston 26.

The cylinder body 24 is provided with a first pressure sensor (pressure detection unit) 30 capable of detecting the pressure of air in the head-side cylinder chamber 16, and a second pressure sensor (pressure detection unit) 32 capable of detecting the pressure of air in the rod-side cylinder chamber 18. The detected pressures $P_A$, $P_D$ of the air are outputted from the first and second pressure sensors 30, 32 to a controller C. It should be noted that the first and second pressure sensors 30, 32 are not essential, and may be dispensed with.

Then, in the fluid pressure cylinder 12, during the pushing time (in the driving step) where air is supplied to the head-side cylinder chamber 16, the piston rod 28 moves together with the piston 26 toward the other end of the cylinder body 24 (in the direction indicated by the arrow B), and the piston rod 28 protrudes outward from the cylinder body 24.

On the other hand, during the pulling time (in the returning step) where air is supplied to the rod-side cylinder chamber 18, the piston rod 28 moves together with the piston 26 toward one end of the cylinder body 24 (in the direction indicated by the arrow A), and the piston rod 28 is accommodated inside the cylinder body 24.

The switching valve 14 is a servo valve having 5 ports which are opened/closed in accordance with, e.g., a control signal from the controller C. A first port 34 of the switching valve 14 is connected to the head-side cylinder chamber 16 of the fluid pressure cylinder 12 through a first pipe 36, and a second port 38 thereof is connected to the rod-side cylinder chamber 18 through a second pipe 40.

Intermediate portions of the first pipe 36 and the second pipe 40 are connected together by a bypass pipe 20. An air tank (not shown) may be provided at an intermediate position of the second pipe 40, for substantially increasing the volume of the rod-side cylinder chamber 18.

Further, a third port 42 of the switching valve 14 is connected to a first exhaust port 46 communicating with the outside through a third pipe 44. Further, a fourth port 48 thereof is connected to an air supply source (supply source) 52 for supplying high-pressure air through a fourth pipe 50, and a fifth port 54 thereof is connected to a second exhaust port 58 communicating with the outside through a fifth pipe 56.

When the switching valve 14 is placed in a first switching position P1 shown in FIG. 1, the first port 34 and the fourth port 48 communicate with each other, so that the air supply source 52 connected to the fourth port 48 and the head-side cylinder chamber 16 of the fluid pressure cylinder 12 are placed in communication with each other. Further, the second port 38 and the fifth port 54 communicate with each other, so that the rod-side cylinder chamber 18 and the second exhaust port 58 are connected and communicate with each other.

Figure 2:
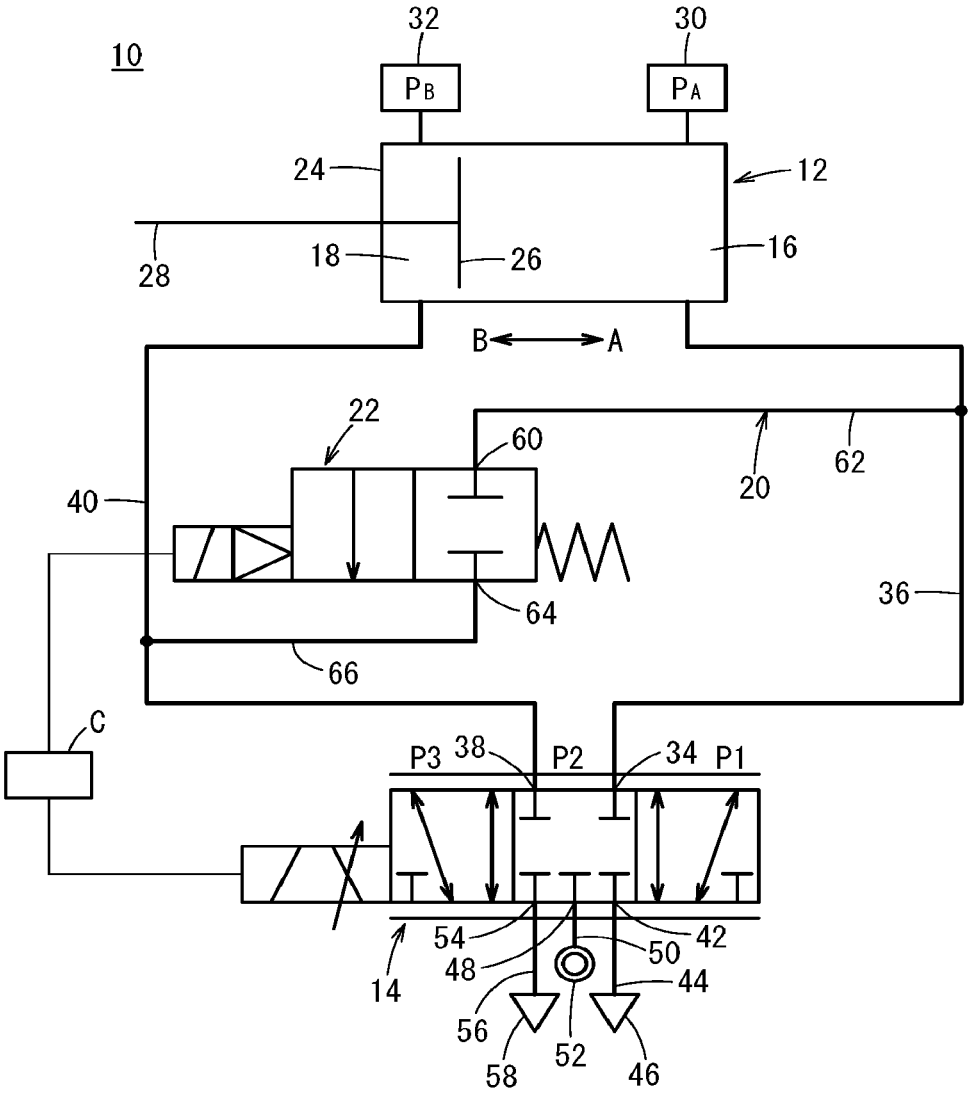
FIG. 2 is a circuit diagram when the fluid pressure cylinder is operated to move toward a pushing side, and the fluid pressure cylinder is held in position, in the driving apparatus in FIG. 1.

Further, when the switching valve 14 is placed in a second switching position P2 shown in FIG. 2, the first port 34 and the second port 38 are not connected to any of the third to fifth ports 42, 48, 54. Therefore, supply of air from the air supply source 52 to the fluid pressure cylinder 12, and discharge of air from the fluid pressure cylinder 12 are interrupted and stopped by the switching valve 14.

Figure 4:
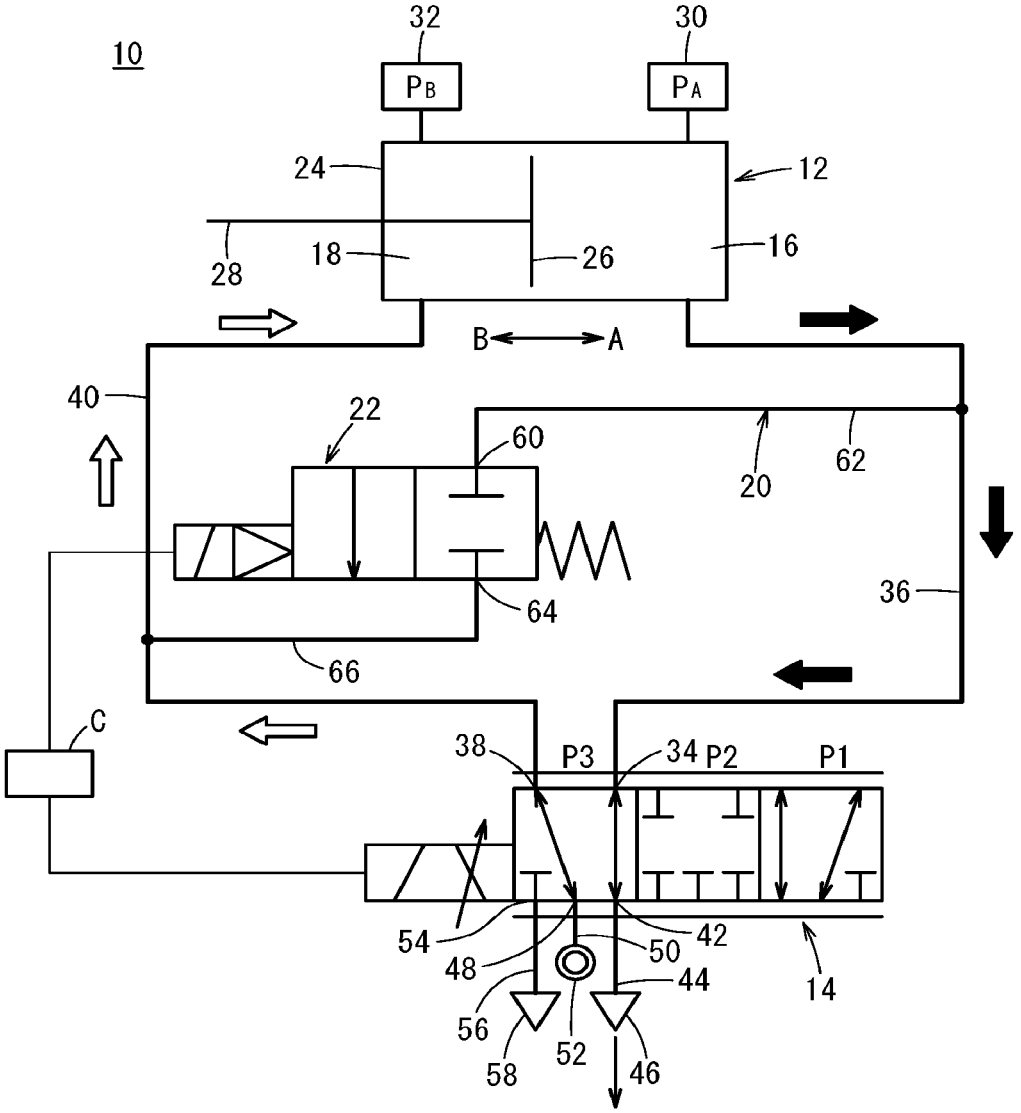
FIG. 4 is a circuit diagram when the fluid pressure cylinder is operated to move further toward the pulling side, in the driving apparatus in FIG. 3.

Further, when the switching valve 14 is placed in a third switching position P3 shown in FIG. 4, the first port 34 and the third port 42 communicate with each other, and thus the head-side cylinder chamber 16 and the first exhaust port 46 communicate with each other. Further, the second port 38 and the fourth port 48 communicate with each other, and thus the air supply source 52 and the rod-side cylinder chamber 18 of the fluid pressure cylinder 12 are connected to and communicate with each other.

The above switching valve 14 can successively switch between the first to third switching positions P1 to P3 by a control signal from the controller C.

The bypass switching valve 22 is a solenoid valve having two ports which can be opened/closed in accordance with a control signal from the controller C. A first bypass port 60 is connected to an upstream channel 62 of the bypass pipe 20, and thus communicates with the first pipe 36. A second bypass port 64 is connected to a downstream channel 66 of the bypass pipe 20, and is thus connected to and communicates with the second pipe 40.

At a non-energized state, the bypass switching valve 22 is in a closed state where communication between the upstream channel 62 and the downstream channel 66 is interrupted by a valve plug (not shown). When the bypass switching valve 22 is energized by operation of the controller C, communication between the first and second bypass ports 60, 64 is established, and the upstream channel 62 and the downstream channel 66 are in communication with each other.

That is, the bypass switching valve 22 and the switching valve 14 are driven under control of one controller C.

The driving apparatus 10 of the fluid pressure cylinder 12 according to the embodiment of the present invention basically has the above structure, and operation and working effects thereof will be described below. In the following description, a state as shown in FIG. 1, i.e., the switching valve 14 is in the first switching position P1, the bypass switching valve 22 is placed in the closed state, and the piston rod 28 is pulled to a position closest to the cylinder body 24 (in the direction indicated by the arrow A), is assumed as an initial state.

In the case where the driving step is performed to cause the fluid pressure cylinder 12 to perform a pushing operation from the initial state, after air from the air supply source 52 flows to the fourth port 48 and the first port 34 of the switching valve 14 through the fourth pipe 50, the air is supplied from the first pipe 36 to the head-side cylinder chamber 16 of the fluid pressure cylinder 12.

In this regard, since the bypass switching valve 22 is in a closed state of interrupting communication of the bypass pipe 20, the air flowing through the first pipe 36 does not flow toward the second pipe 40 through the bypass pipe 20.

Then, by the air supplied to the head-side cylinder chamber 16 of the cylinder body 24, the piston 26 is pushed toward the other end of the cylinder body 24 (in the direction indicated by the arrow B), and moves together with the piston rod 28. By this movement of the piston 26, the air in the rod-side cylinder chamber 18 is discharged through the second pipe 40, and the air is discharged from the second exhaust port 58 to the outside through the second port 38 and the fifth port 54 of the switching valve 14, and the fifth pipe 56.

By movement of the piston 26 toward the other end in the driving step, as shown in FIG. 2, the piston rod 28 is pushed and protrudes up to a position where a protrusion amount from the other end of the cylinder body 24 becomes the maximum.

Further, as shown in FIG. 2, by the control signal to the switching valve 14 from the controller C, the switching valve 14 is switched from the first switching position P1 to the second switching position P2, to thereby stop supply of air from the air supply source 52 to the head-side cylinder chamber 16. Further, since discharge of air from the rod-side cylinder chamber 18 to the second exhaust port 58 is stopped concurrently, the piston rod 28 is held in a state of being extended to the maximum position.

Figure 3:
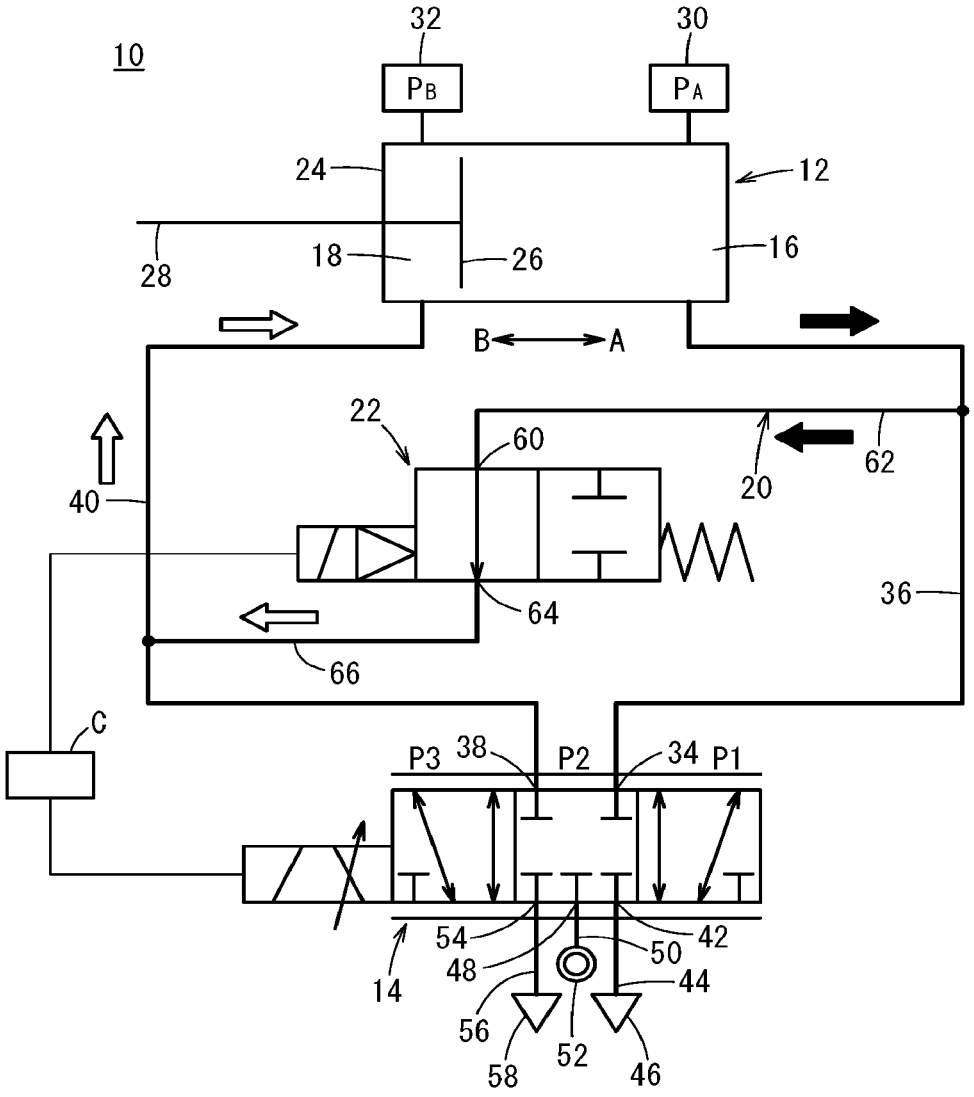
FIG. 3 is a circuit diagram when the fluid pressure cylinder is operated to move toward a pulling side by a discharged air, in the driving apparatus in FIG. 2.

Next, in the fluid pressure cylinder 12, at the time of performing pulling operation (returning step) for returning from the holding state of the piston 26 and the piston rod 28 to the initial state, in the state shown in FIG. 2, the bypass switching valve 22 is switched from the closed state to the open state shown in FIG. 3, by the control signal from the controller C.

Then, as shown in FIG. 3, by switching operation of the bypass switching valve 22, the first bypass port 60 and the second bypass port 64 are placed in communication with each other. Accordingly, the upstream channel 62 and the downstream channel 66 of the bypass pipe 20 communicate with each other.

As a result, the high-pressure air in the head-side cylinder chamber 16 supplied from the air supply source 52 flows toward a first bypass port 60 of the bypass switching valve 22 through the first pipe 36 and the upstream channel 62, and then supplied to the rod-side cylinder chamber 18 under the atmospheric pressure, i.e., low pressure, through the second bypass port 64, the downstream channel 66, and the second pipe 40.

That is, the head-side cylinder chamber 16 and the rod-side cylinder chamber 18 are caused to communicate with the bypass pipe 20. Thus, by the pressure difference between the air in the head-side cylinder chamber 16 and the air in the rod-side cylinder chamber 18, the air flows from the head-side cylinder chamber 16 toward the rod-side cylinder chamber 18.

Further, the piston 26 is pushed toward one end of the cylinder body 24 (in the direction indicated by the arrow A) by the air supplied to the rod side cylinder chamber 18, and the piston 26 starts to move. With movement of the piston 26, the piston rod 28 moves together, and is then pulled into the cylinder body 24.

At this time, since the switching valve 14 is at the second switching position P2 where the supply/discharge of the air is interrupted, the air flowing through the first pipe 36 and the second pipe 40 does not flow toward the switching valve 14.

Stated otherwise, the exhaust air discharged from the head-side cylinder chamber 16 is supplied to the rod-side cylinder chamber 18. In this manner, it becomes possible to move the piston 26 toward one end of the cylinder body 24, utilizing the exhaust air. That is, the bypass pipe 20 and the bypass switching valve 22 jointly function as an exhaust fluid supply unit for supplying the exhaust air from the head-side cylinder chamber 16 to the rod-side cylinder chamber 18.

As described above, after the piston 26 and the piston rod 28 start to be pulled toward one end of the cylinder body 24 (in the direction indicated by the arrow A) utilizing the exhaust air, the pressure $P_A$ of the head-side cylinder chamber 16 and the pressure $P_B$ of the rod-side cylinder chamber 18 detected by the first pressure sensor 30 and the second pressure sensor 32 are compared with each other.

Then, before at least the pressure $P_A$ of the head-side cylinder chamber 16 becomes equal to the pressure $P_B$ of the rod-side cylinder chamber 18, based on the control signal from the controller C, as shown in FIG. 4, the bypass switching valve 22 is switched into the closed state to thereby interrupt communication of the bypass pipe 20, and the control signal is outputted from the controller C to the switching valve 14 for thereby switching the switching valve 14 from the second switching position P2 to the third switching position P3.

Therefore, the supply of the air from the head-side cylinder chamber 16 to the rod-side cylinder chamber 18 through the bypass pipe 20 is stopped, and the air from the air supply source 52 is supplied from the second pipe 40 to the rod-side cylinder chamber 18 through the fourth port 48 and the second port 38. As a result, the piston 26 is pushed further toward the one end of the cylinder body 24 (in the direction indicated by the arrow A), by the air supplied from the air supply source 52 instead of the air discharged from the head-side cylinder chamber 16, and moves continuously.

In the switching valve 14, the first port 34 and the third port 42 communicate with each other, and the air remaining in the head-side cylinder chamber 16 is discharged to the outside from the first exhaust port 46 through the first pipe 36 and the third pipe 44. Then, the air supplied from the air supply source 52 to the rod-side cylinder chamber 18 moves the piston 26 further toward the one end of the cylinder body 24 (in the direction indicated by the arrow A), and the piston rod 28 shown in FIG. 1 returns to the initial state where the piston rod 28 is pulled into the cylinder body 24 to the greatest extent.

As described above, in the embodiment of the present invention, in the driving apparatus 10 for driving the fluid pressure cylinder 12, the bypass pipe 20 connecting the head-side cylinder chamber 16 and the rod-side cylinder chamber 18 is provided, and the bypass switching valve 22 capable of switching the communication state of the bypass pipe 20 is provided. Then, when the piston rod 28 is pulled from the pushed state where the piston rod 28 protrudes to the outside of the cylinder body 24, the bypass switching valve 22 is placed in the open state to thereby supply the air discharged from the head-side cylinder chamber 16 to the rod-side cylinder chamber 18 through the bypass pipe 20.

Therefore, in the returning step of the fluid pressure cylinder 12, the piston 26 and the piston rod 28 are driven utilizing the air discharged from the head-side cylinder chamber 16. With this configuration, in comparison with the case where the pulling operation is performed utilizing only the air from the air supply source 52, it is possible to reduce consumption of air, and achieve energy saving.

Further, in the returning step for performing pulling operation of the piston 26, when the piston 26 starts to move, the exhaust air from the head-side cylinder chamber 16 is supplied to thereby increase the pressure in the rod-side cylinder chamber 18 and decrease the pressure in the head-side cylinder chamber 16 concurrently. Therefore, it becomes possible to perform returning operation of the fluid pressure cylinder 12 rapidly.

As a result, in the returning step (at the time of performing the pulling operation) of the fluid pressure cylinder 12, the piston 26 is driven by utilizing the exhaust air. In this manner, it becomes possible to reduce air consumption, and further reduce the time required for the returning step of returning the piston 26 to the initial position.

Further, the bypass pipe 20 connecting the head-side cylinder chamber 16 and the rod-side cylinder chamber 18 in the fluid pressure cylinder 12, and the bypass switching valve 22 for switching the communication state of the bypass pipe 20 are provided. With such a simple structure, it is possible to realize the driving apparatus 10 for driving the fluid pressure cylinder 12 which makes it possible to perform the returning step utilizing the discharged air.

Furthermore, since the servo valve is used as the switching valve 14, at the time of performing the driving step and the returning step repeatedly and successively, the stroke quantity (displacement quantity) of the fluid pressure cylinder 12 can be minimized suitably.

Next, as an example, a case where the driving apparatus 10 for the above described fluid pressure cylinder 12 is used for the purpose of switching between griping and non-griping (releasing) of a workpiece W by a welding gun 68 in a welding line will be described with reference to FIGS. 5 to 8.

As shown in FIGS. 5 to 8, the welding gun 68 includes a gun body 70, an arm 72 extending from the gun body 70, and a first electrode 74 provided at a distal end of the arm 72. Further, in the welding gun 68, the fluid pressure cylinder 12 is held by the gun body 70, the piston rod 28 is provided so as to be movable toward and away from the first electrode 74, and a second electrode 76 is provided at the other end of the piston rod 28.

That is, the second electrode 76 is provided to face the first electrode 74, and moves closer to or away from the first electrode 74 under the driving operation of the fluid pressure cylinder 12. Further, the first electrode 74 and the second electrode 76 are electrically connected to a power supply (not shown) and a transformer (not shown) so that the first electrode 74 and the second electrode 76 can be energized.

Figure 5:
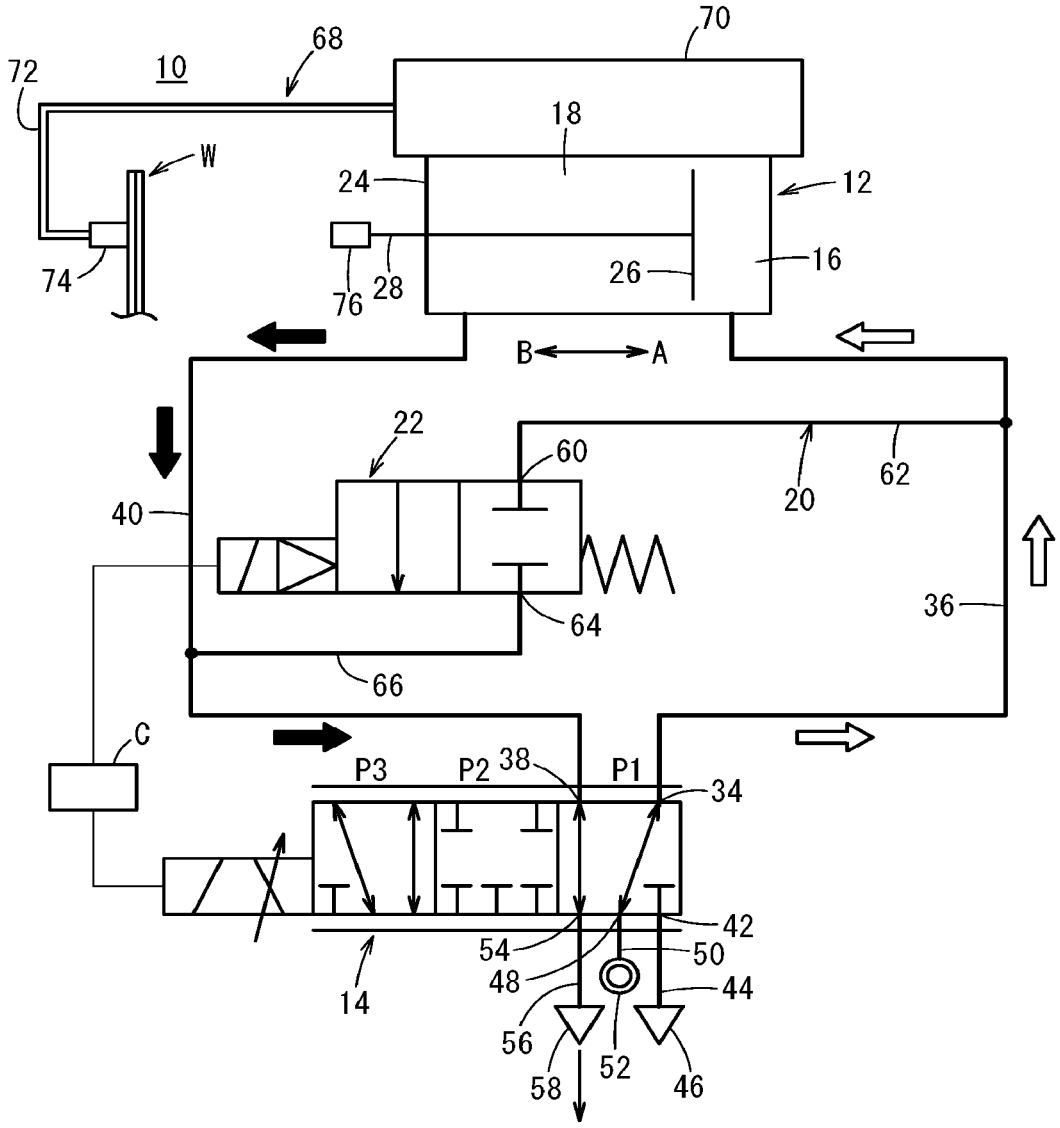
FIG. 5 is a circuit diagram in a case where a welding gun is driven using the apparatus for driving the fluid pressure cylinder in FIG. 1.

Next, in the case of driving the welding gun 68 using the driving apparatus 10 for the fluid pressure cylinder 12, in the non-gripping state, as shown in FIG. 5, of the workpiece W where the first electrode 74 and the second electrode 76 of the welding gun 68 are separated from each other, the workpiece W is put between the first electrode 74 and the second electrode 76. In the following description, a case of welding a pair of laminated plate members as the workpiece W will be described.

Figure 6:
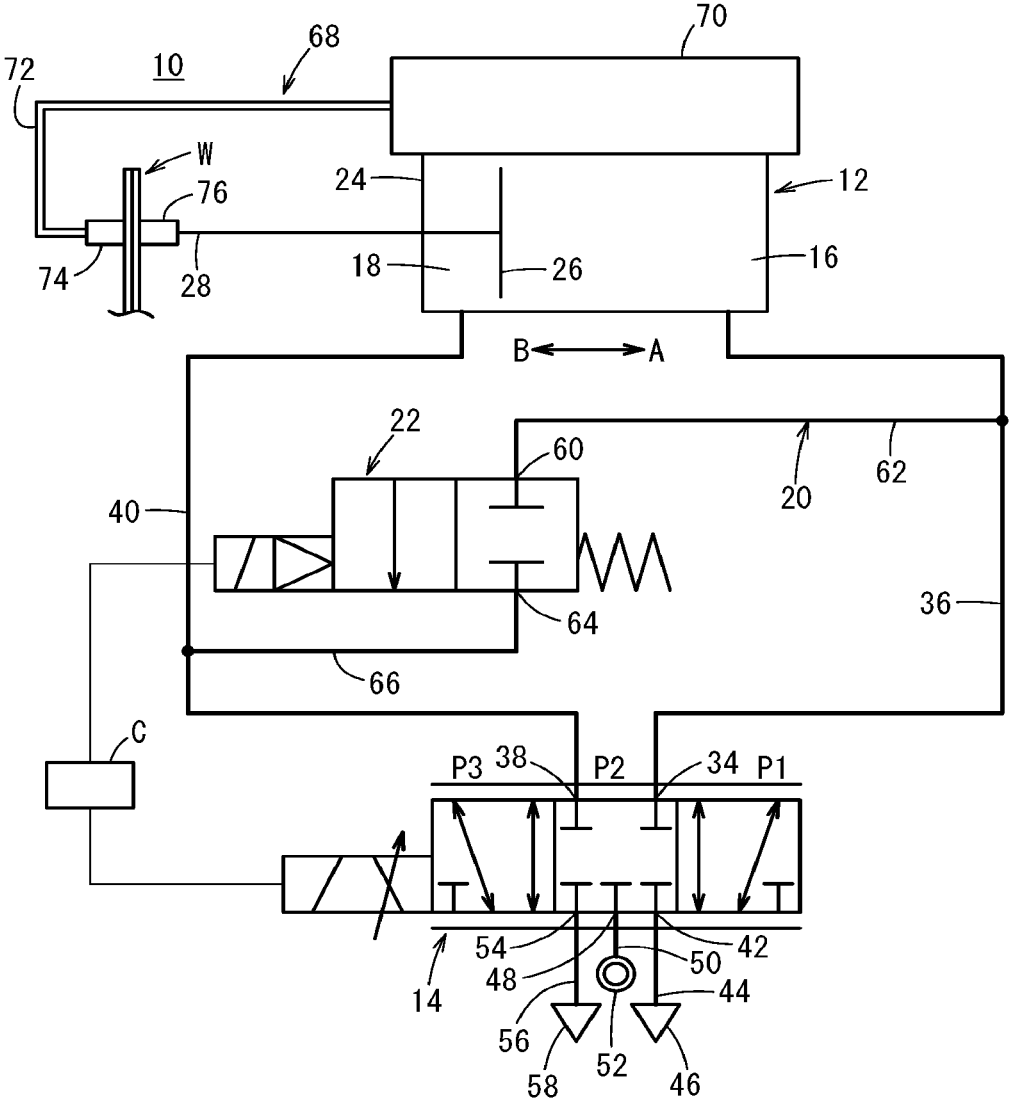
FIG. 6 is a circuit diagram when the fluid pressure cylinder is operated to move toward the pushing side and grip a workpiece, in the driving apparatus in FIG. 5.

Then, in the above state, by performing pushing operation of the fluid pressure cylinder 12 (by performing the step of driving the fluid pressure cylinder 12) under operation of supplying the air to the head-side cylinder chamber 16, the piston 26 and the piston rod 28 move toward the other end (in the direction indicated by the arrow B), whereby the second electrode 76 moves closer to the first electrode 74, and as shown in FIG. 6, the workpiece W is gripped and held between the first electrode 74 and the second electrode 76 at a predetermined pressing force.

At this time, in the driving apparatus 10, the switching speed of the switching valve 14 is adjusted between the first port 34 and the fourth port 48, and the quantity of air supplied to the fluid pressure cylinder 12 is adjusted. In this manner, it is possible to reduce the contact speed when the second electrode 76 contacts the workpiece W, and thus alleviate the impact at the time of contact.

Next, as shown in FIG. 6, in the state where the workpiece W is gripped between the first electrode 74 and the second electrode 76 of the welding gun 68, supply of the air from the switching valve 14 to the fluid pressure cylinder 12 is stopped, and discharge of the air from the fluid pressure cylinder 12 is stopped. In this manner, the workpiece W is gripped between the first electrode 74 and the second electrode 76 with a predetermined pressing force (welding pressure), and the gripping state is maintained.

In the gripping state of gripping the workpiece W by the welding gun 68, by energizing the first electrode 74 and the second electrode 76 through the power supply and the transformer (not shown), the contact region of the workpiece W is melt by heat produced by the first electrode 74 and the second electrode 76, and the workpiece W is then welded.

Figure 7:
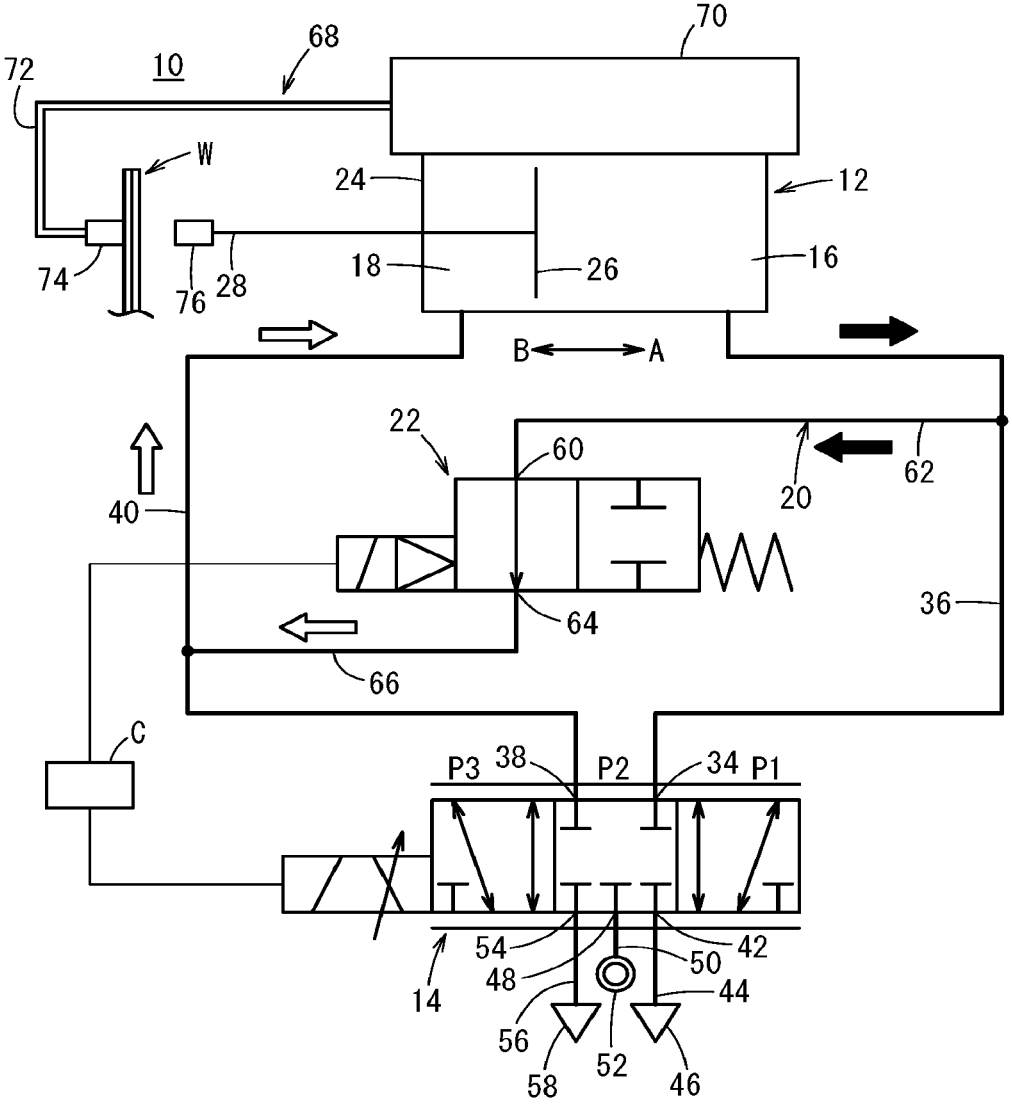
FIG. 7 is a circuit diagram when the fluid pressure cylinder is operated to move toward the pulling side by the discharged air and is placed in a state where the workpiece is released, in the driving apparatus in FIG. 6.

Further, after welding of the workpiece W is finished, in order to release the gripping state of the workpiece W, as shown in FIG. 7, the fluid pressure cylinder 12 is driven in the returning step, and under the switching operation of the bypass switching valve 22, the air discharged from the head-side cylinder chamber 16 is supplied to the rod-side cylinder chamber 18. As a result, the pulling operation to move the piston 26 and the piston rod 28 toward one end (in the direction indicated by the arrow A) is started. Accordingly, the second electrode 76 moves away from the workpiece W and the first electrode 74.

Figure 8:
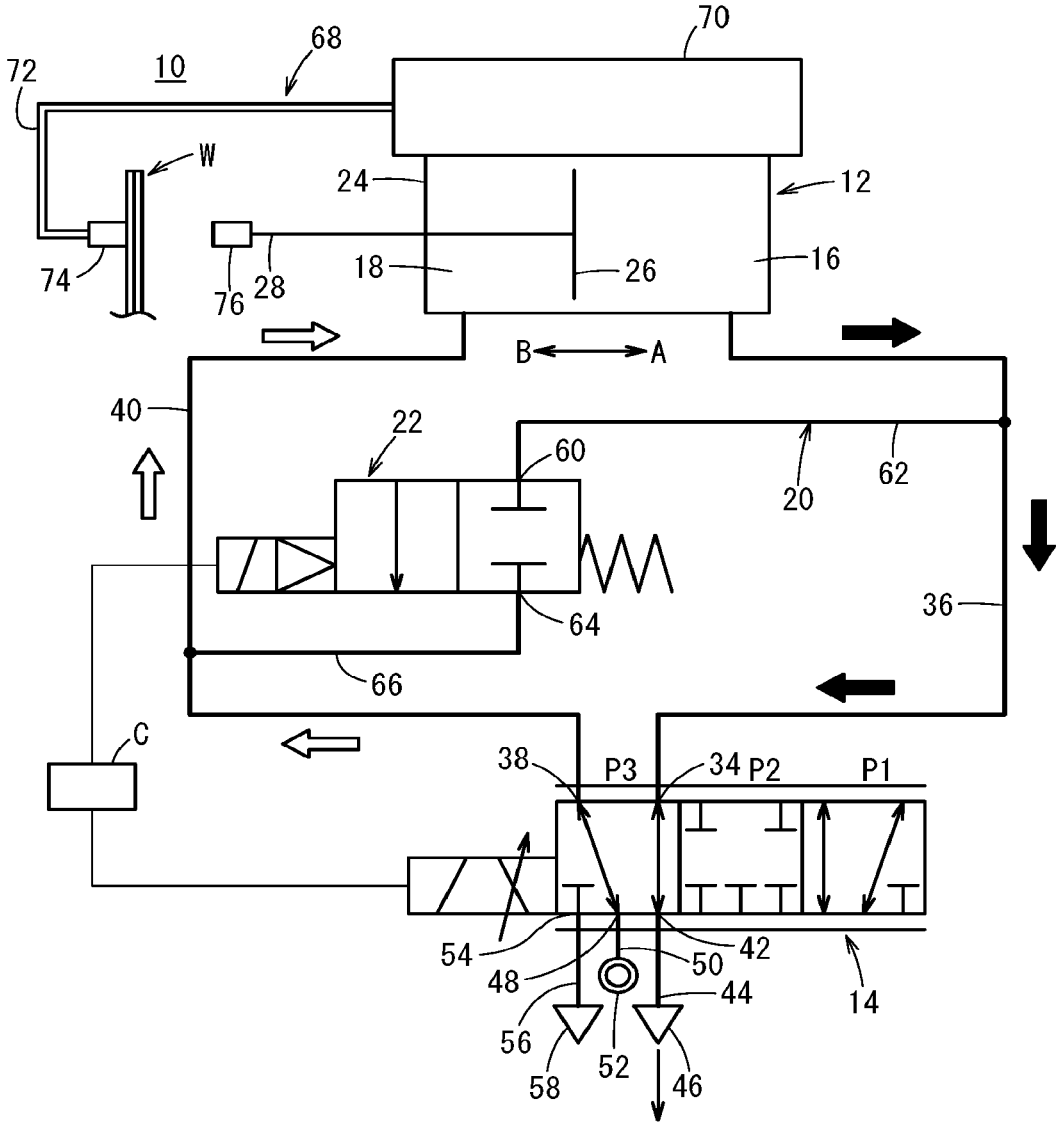
FIG. 8 is a circuit diagram when the fluid pressure cylinder is operated to move further toward the pulling side, in the driving apparatus in FIG. 7.

Further, in the state where the first electrode 74 and the second electrode 76 of the welding gun 68 shown in FIG. 7 are opened, as shown in FIG. 8, the bypass switching valve 22 is switched to stop supply of the air from the head-side cylinder chamber 16 to the rod-side cylinder chamber 18, and air from the air supply source 52 is supplied to the rod-side cylinder chamber 18 under switching operation of the switching valve 14. As a result, the piston 26 and the piston rod 28 are successively pushed toward one end (in the direction indicated by the arrow A) and move, so that the first electrode 74 and the second electrode 76 are further separated away from each other, and then spaced from each other at a predetermined interval.

At this time, the pressure in the rod-side cylinder chamber 18 is detected by a pressure sensor (not shown), and the position of the piston 26 is detected by a position detection sensor (not shown). Thus, the movement distance and the position of the piston 26 and the piston rod 28 toward one end (in the direction indicated by the arrow A) are detected.

After it is confirmed that the piston 26 and the piston rod 28 have reached predetermined positions and have moved by a predetermined distance, supply of the air from the air supply source 52 to the fluid pressure cylinder 12 is stopped.

As a result, movement of the second electrode 76 in a direction away from the first electrode 74 (in the direction indicated by the arrow A) is stopped, and as shown in FIG. 8, the first electrode 74 and the second electrode 76 are held in a state of being spaced at a predetermined interval. For example, the predetermined interval is determined such that the workpiece W can be inserted in between the first electrode 74 and the second electrode 76. Stated otherwise, the predetermined positions and the predetermined movement distance of the piston 26 and the piston rod 28 are set so that movement of the second electrode 76 can be stopped at such a position that the first electrode 74 and the second electrode 76 are spaced at the above predetermined interval.

As described above, after the non-gripping state of the workpiece W is brought about in which the first electrode 74 and the second electrode 76 of the welding gun 68 are sufficiently spaced from each other, the workpiece W is moved relative to the welding gun 68, and a portion of the workpiece W to be newly welded is placed at a position facing the first electrode 74 and the second electrode 76. Then, as shown in FIG. 6, the fluid pressure cylinder 12 is caused to perform pushing operation again to thereby grip and weld the new portion of the workpiece W.

That is, by alternately performing the driving step and the returning step of the fluid pressure cylinder 12, and performing gripping/non-gripping (releasing) of the workpiece W by the welding gun 68 successively and repeatedly, it is possible to successively perform welding on a plurality of portions of the workpiece W.

Further, in the returning step for releasing the workpiece W in order to weld the next portion of the workpiece W after welding of the predetermined portion has been finished, the piston 26 is moved toward the one side (in the direction indicated by the arrow A) by a distance which makes it possible for the workpiece W to be inserted between the second electrode 76 and the first electrode 74, not moved completely to the one end of the head-side cylinder chamber 16.

Therefore, in comparison with the case where the piston 26 is moved fully to one end of the cylinder body 24 in the returning step, it is possible to reduce air consumption, and reduce the operation time (task time) from when the process is switched from the returning step to the driving step until when the workpiece W is gripped again. As a result, it is possible to achieve both of energy saving and improvement of the operation efficiency of the fluid pressure cylinder 12.

Figure 9A:
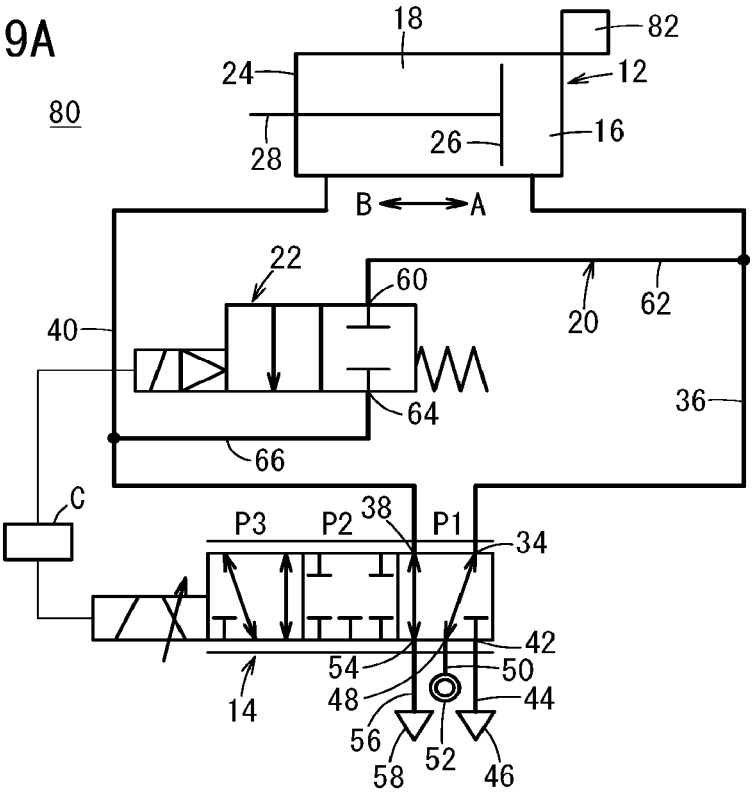
FIG. 9A is a circuit diagram showing an apparatus for driving a fluid pressure cylinder according to a first modified embodiment.

Further, as in the case of a driving apparatus 80 according to a first modified embodiment FIG. 9A, the fluid pressure cylinder 12 may be provided with a displacement sensor 82 capable of detecting the displacement, along the axial direction (indicated by the arrows A and B), of the piston 26 in the cylinder body 24, instead of the first pressure sensor 30 and the second pressure sensor 32. As in the case of a driving apparatus 84 according to a second modified embodiment shown in FIG. 9B, the fluid pressure cylinder 12 may be provided with position detection sensors 86*a*, 86*b* capable of detecting positions of the piston 26 in the axial direction (indicated by the arrows A and B).

As the above displacement sensor 82, for example, an optical sensor may be used, and as the position detection sensors 86*a*, 86*b*, magnetic sensors capable of detecting magnetic change of a magnet (not shown) attached to the piston 26 may be used.

Thus, for example, the driving apparatus 80 shown in FIG. 9A switches the bypass switching valve 22 based on displacement of the piston 26 detected by the displacement sensor 82, and switches the switching valve 14 from the first switching position P1 to the third switching position P3, in correspondence with the bypass switching valve 22. In this manner, it is possible to switch the supply state between the air discharged from the head-side cylinder chamber 16 to the rod-side cylinder chamber 18 and the air supplied from the air supply source 52 thereto.

Figure 9B:
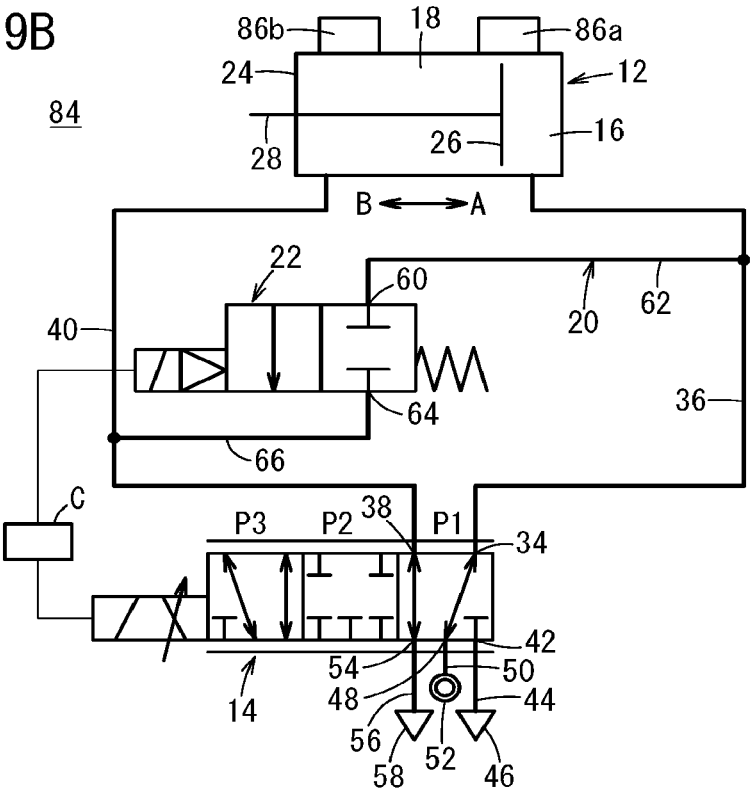
FIG. 9B is a circuit diagram showing an apparatus for driving a fluid pressure cylinder according to a second modified embodiment.

Further, in the driving apparatus 84 shown in FIG. 9B, the bypass switching valve 22 is switched based on the position of the piston 26 detected by the position detection sensors 86*a*, 86*b*, and the switching valve 14 is switched from the first switching position P1 to the third switching position P3 in correspondence with the bypass switching valve 22. In this manner, it is possible to switch the supply state between air discharged from the head-side cylinder chamber 16 to the rod-side cylinder chamber 18 and the air supplied from the air supply source 52 thereto.

Further, drive control concerning when to switch the bypass switching valve 22 from the open state to the closed state may be performed, e.g., by measuring the time that has elapsed since the start of the returning step, and when the elapsed time reaches a predetermined time, outputting a control signal from the controller C to the bypass switching valve 22.

Figure 10:
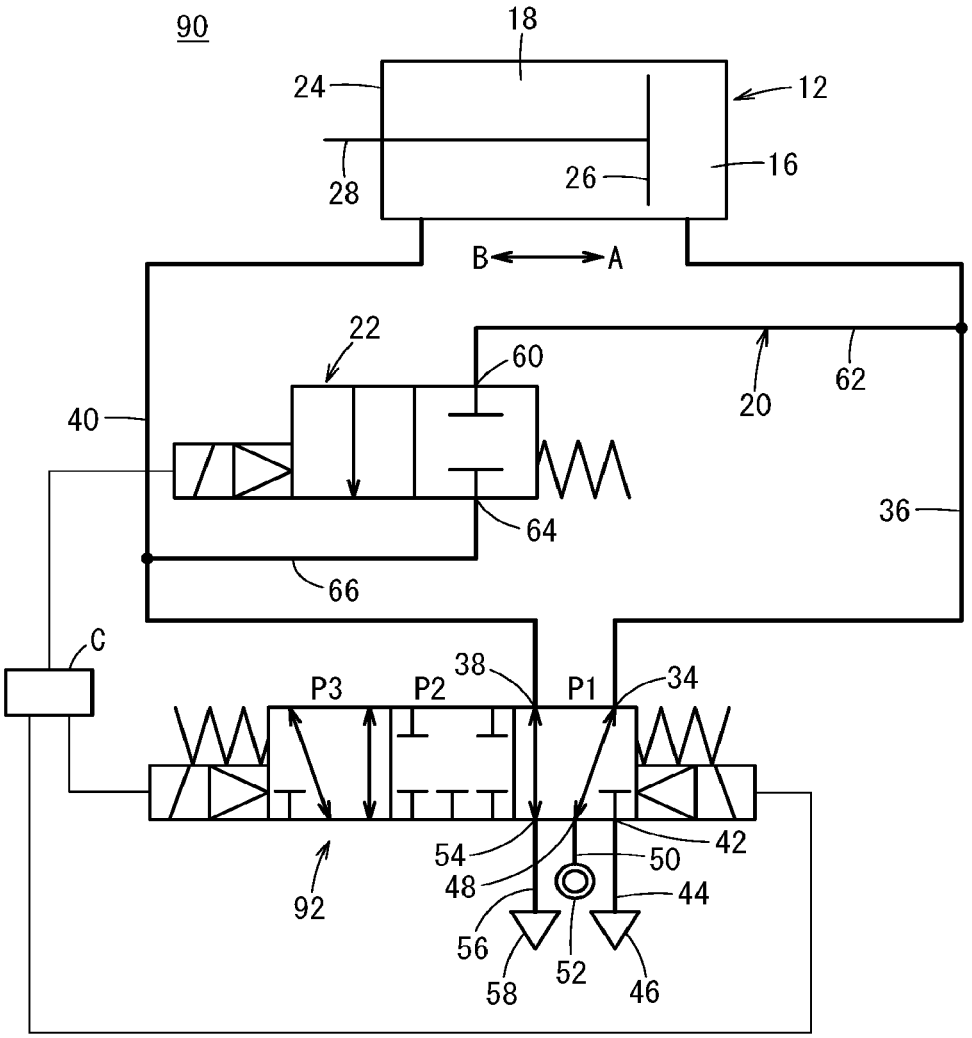
FIG. 10 is a circuit diagram showing an apparatus for driving a fluid pressure cylinder according to a third modified embodiment.

Furthermore, instead of adopting the switching valve 14 in the form of the servo valve having the five ports in the driving apparatus 10 as shown in FIG. 1, as in the case of a driving apparatus 90 according to a third embodiment shown in FIG. 10, a solenoid valve having five ports may be used as a switching valve 92.

Figure 11A:
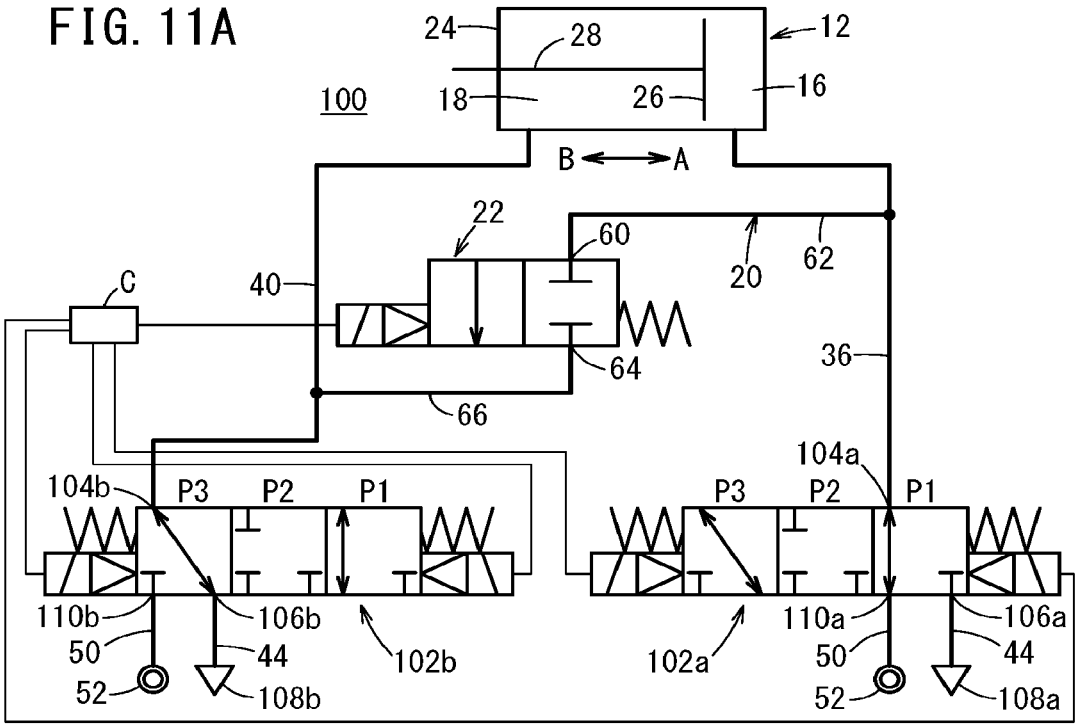
FIG. 11A is a circuit diagram showing an apparatus for driving a fluid pressure cylinder according to a fourth modified embodiment.

Moreover, instead of the switching valve 14 having 5 ports in the driving apparatus 10 shown in FIG. 1, as in the case of a driving apparatus 100 according to a fourth modified embodiment shown in FIG. 11A, a pair of switching valves 102*a*, 102*b* each comprising a solenoid valve having three ports may be provided.

In this driving apparatus 100, a first port 104*a* of one switching valve 102*a* is connected to the head-side cylinder chamber 16 of the fluid pressure cylinder 12 through a first pipe 36. A second port 106*a* thereof communicates with the outside through an exhaust port 108*a* connected to a third pipe 44. Further, a third port 110*a* thereof is connected to an air supply source 52 through a fourth pipe 50.

A first port 104*b* of the other switching valve 102*b* is connected to the rod-side cylinder chamber 18 of the fluid pressure cylinder 12 through the second pipe 40. A second port 106*b* thereof communicates with the outside through the exhaust port 108*b* connected to the third pipe 44. Further, a third port 110*b* thereof is connected to the air supply source 52 through the fourth pipe 50.

Further, as shown in FIG. 11A, under energization operation by the controller C, the switching valve 102*a* is placed in the first switching position P1, so that the air supply source 52 and the head-side cylinder chamber 16 communicate with each other to thereby supply air. As a result, the piston 26 and the piston rod 28 move toward the other end of the fluid pressure cylinder 12 (toward the pushing side in the direction indicated by the arrow B). At the same time, the other switching valve 102*b* is placed in the third switching position P3, so that the rod-side cylinder chamber 18 and the exhaust port 108*b* communicate with each other, to thereby discharge the air in the rod-side cylinder chamber 18 to the outside.

Further, in the state where the pair of switching valves 102*a*, 102*b* are switched to the second position P2, respectively, by switching the bypass switching valve 22, it is possible to supply the air in the head-side cylinder chamber 16 to the rod-side cylinder chamber 18 to thereby move the piston 26 toward the pulling side (in the direction indicated by the arrow A).

Then, after switching the bypass switching valve 22 to interrupt communication of the bypass pipe 20, the other switching valve 102*b* is switched from the third switching position P3 to the first switching position P1. As a result, the air supply source 52 and the rod-side cylinder chamber 18 communicate with each other, and the air is then supplied to the rod-side cylinder chamber 18. The piston 26 and the piston rod 28 are moved toward the pulling side (in the direction indicated by the arrow A). At the same time, the one switching valve 102*a* is switched from the first switching position P1 to the third switching position P3. As a result, the head-side cylinder chamber 16 communicates with the outside, and the air is then discharged from the exhaust port 108*a*.

Figure 11B:
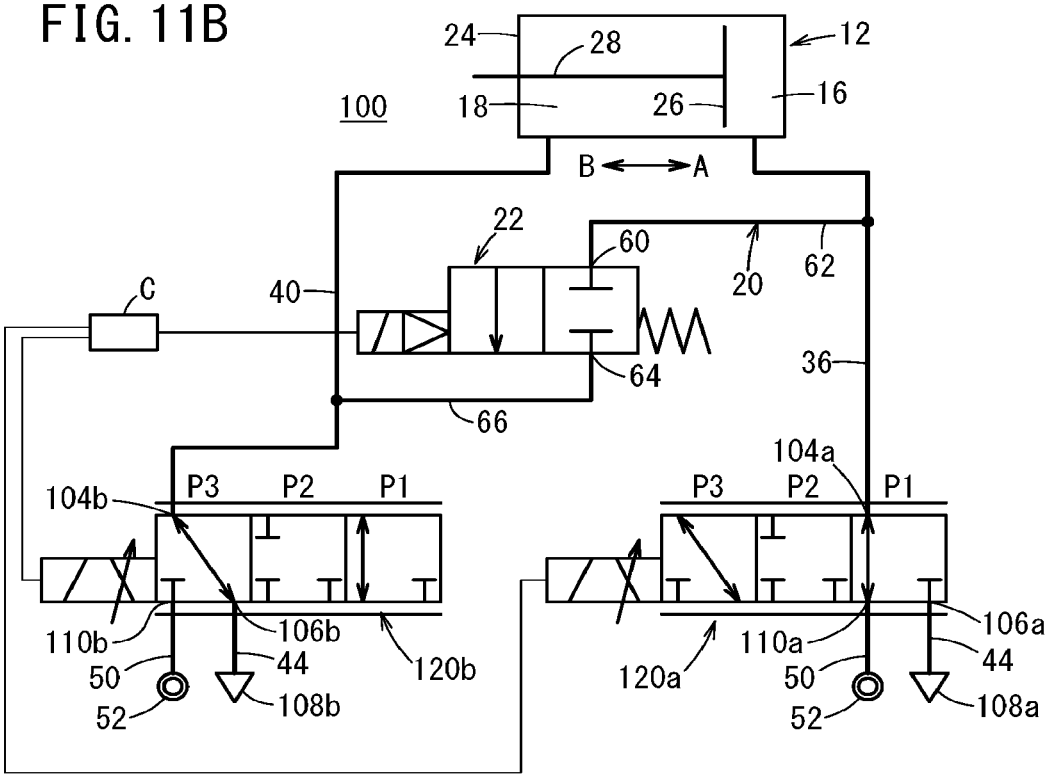
FIG. 11B is a circuit diagram where a switching valve of the driving apparatus in FIG. 11A is replaced by a servo valve.

Instead of adopting the pair of switching valves 102*a*, 102*b* in the form of a pair of solenoid valves each having three ports shown in FIG. 11A, a pair of switching valves 120*a*, 120*b* in the form of servo valves each having three ports shown in FIG. 11B may be adopted.

Figure 12A:
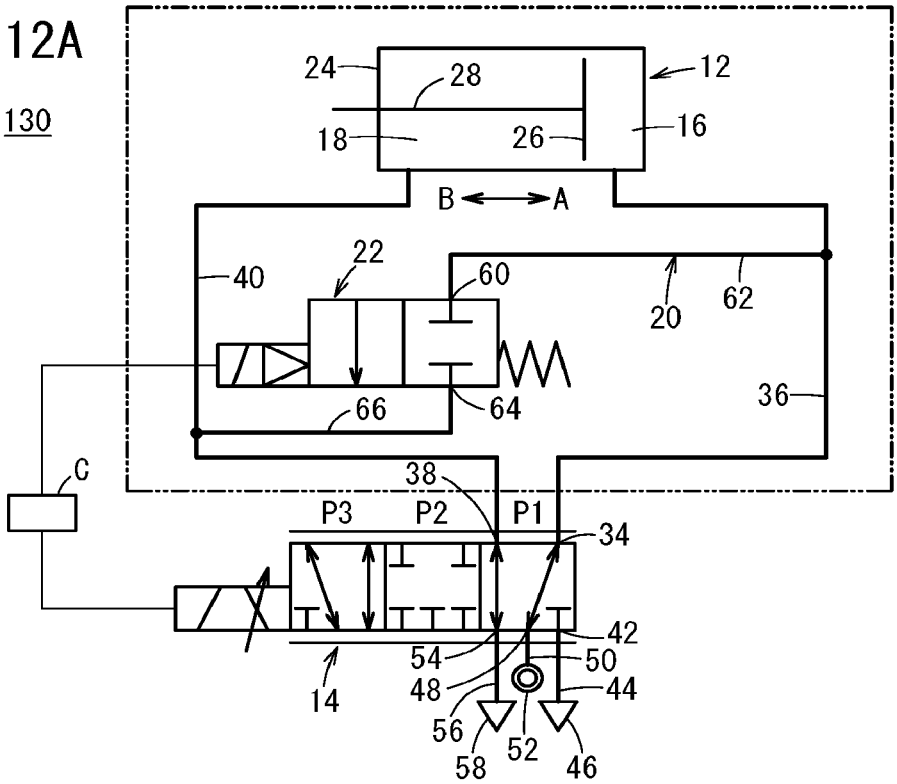
FIG. 12A is a circuit diagram of a driving apparatus according to a fifth modified embodiment where a bypass pipe and a bypass switching valve are incorporated in the fluid pressure cylinder.
Figure 12B:
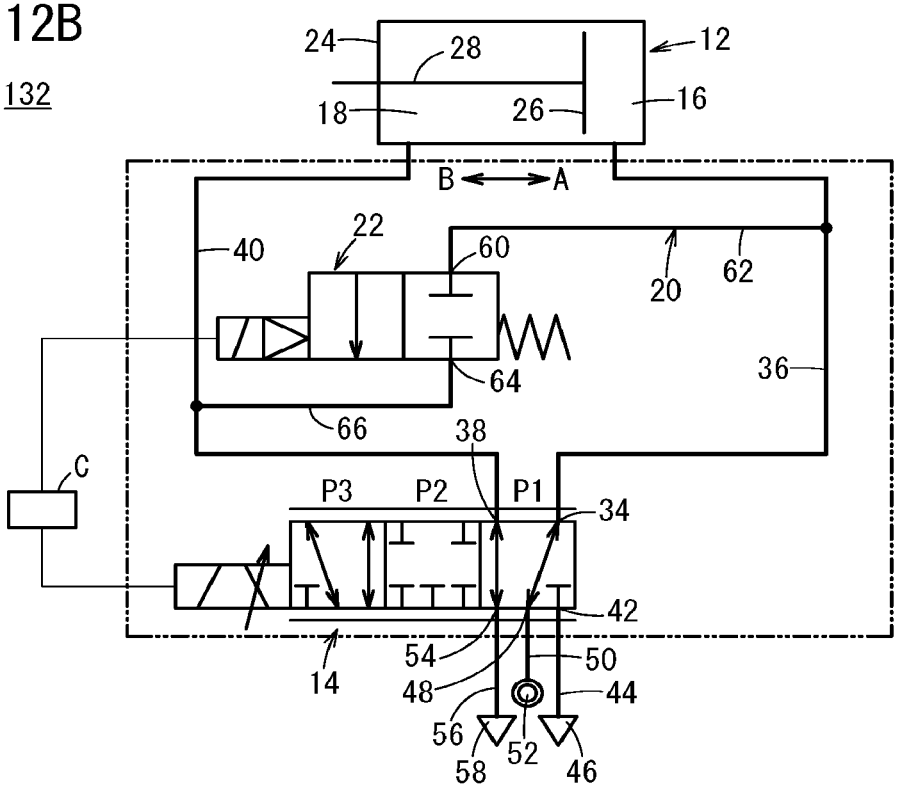
FIG. 12B is a circuit diagram showing a driving apparatus according to a sixth embodiment where a bypass pipe and a bypass switching valve are incorporated in a switching valve.

Further, the present invention is not limited to the case where the bypass pipe 20 and the bypass switching valve 22 are provided separately from the fluid pressure cylinder 12 and the switching valve 14 as described above. For example, as in the case of a driving apparatus 130 according to a fifth modified embodiment shown in FIG. 12A, the bypass pipe 20 and the bypass switching valve 22 may be provided integrally with the cylinder body 24 of the fluid pressure cylinder 12, and as in the case of a driving apparatus 132 according to a sixth modified embodiment shown in FIG. 12B, the bypass pipe 20 and the bypass switching valve 22 may be provided integrally with the switching valve 14.

By adopting the structure, it is possible to simplify and downsize the structure including a circuit of the driving apparatus 130, 132, and also simplify operation of connecting the first pipe 36 and the second pipe 40 to the fluid pressure cylinder 12 and the switching valve 14.

The method and the apparatus for driving the fluid pressure cylinder 12 according to the present invention are not limited to the above described embodiments. It is a matter of curse that various structures may be adopted without deviating from the gist of the present invention.

The invention claimed is:

1. A driving method of driving a fluid pressure cylinder under operation of supplying fluid, comprising:

a driving step of moving a piston in one direction; and a returning step of moving the piston in another direction, wherein:

in the driving step, the fluid is supplied from a supply source to one cylinder chamber of cylinder chambers in the fluid pressure cylinder while the fluid is discharged from another cylinder chamber of the cylinder chambers to outside; and the returning step comprises the steps of:

supplying part of the fluid accumulated in the one cylinder chamber to the other cylinder chamber, to thereby move the piston in the other direction by a predetermined distance; and supplying fluid from the supply source to the other cylinder chamber to thereby further move the piston in the other direction and discharging the fluid from the one cylinder chamber to outside, wherein, in the returning step, switching of a supply state of the fluid from the one cylinder chamber to the other cylinder chamber is performed by a switching valve, wherein pressure detection units configured to detect respective pressures of the one cylinder chamber and the other cylinder chamber are provided, and switching operation of the switching valve is performed based on the pressures detected by the pressure detection units, and wherein, when or before the pressure detected in the one cylinder chamber becomes equal to the pressure detected in the other cylinder chamber, the switching valve is switched to thereby stop supply of the fluid.

2. The driving method according to claim 1, further comprising the step of stopping supply of the fluid to the one cylinder chamber and discharge of the fluid from the other cylinder chamber, after the piston reaches a predetermined position in the driving step.

3. The driving method according to claim 1, wherein after elapse of a predetermined time from starting the returning step, the switching valve is switched to thereby stop supply of the fluid.

4. A driving apparatus for driving a fluid pressure cylinder having a displaceable piston, the driving apparatus comprising:

a supply source configured to supply fluid to the fluid pressure cylinder;

a first switching valve configured to perform switching between a state of supplying the fluid to the fluid pressure cylinder and a state of discharging the fluid from the fluid pressure cylinder;

an exhaust fluid supply unit configured to supply the fluid from one cylinder chamber of cylinder chambers in the fluid pressure cylinder to another cylinder chamber of the cylinder chambers, wherein the exhaust fluid supply unit comprises a connection channel configured to connect the one cylinder chamber and the other cylinder chamber, and a second switching valve configured to switch a flow state of the fluid in the connection channel;

a first pressure sensor configured to detect pressure of the one cylinder chamber;

a second pressure sensor configured to detect pressure of the other cylinder chamber; and a controller configured to perform switching operation of the second switching valve to thereby stop flow of the fluid in the connection channel when or before the pressure of the one cylinder chamber that is detected by the first pressure sensor becomes equal to the pressure of the other cylinder chamber that is detected by the second pressure sensor.

5. The driving apparatus according to claim 4, wherein:

at a first position of the first switching valve, the one cylinder chamber communicates with the supply source, and the other cylinder chamber communicates with an exhaust port opened to outside;

at a second position of the first switching valve, communication of the supply source and the exhaust port with the other cylinder chamber is interrupted, and communication of the connection channel is established by switching operation of the second switching valve to thereby cause the one cylinder chamber and the other cylinder chamber to communicate with each other; and at a third position of the first switching valve, communication of the connection channel is interrupted by the second switching valve, the other cylinder chamber and the supply source communicate with each other, and the one cylinder chamber communicates with outside.

6. The driving apparatus according to claim 4, wherein the first switching valve is a five-port valve.

7. The driving apparatus according to claim 4, wherein the first switching valve is a pair of three-port valves.

8. The driving apparatus according to claim 4, wherein the first switching valve is a servo valve.

9. The driving apparatus according to claim 4, wherein the exhaust fluid supply unit is provided integrally with the fluid pressure cylinder or the first switching valve.

10. The driving apparatus according to claim 4, wherein drive control of the first switching valve and drive control of the second switching valve are performed by one control device.

11. The driving apparatus according to claim 4, wherein the driving apparatus is used in a welding gun configured to weld a workpiece.

* * * * *